US007226898B2

(12) United States Patent
Bragulla

(10) Patent No.: US 7,226,898 B2
(45) Date of Patent: Jun. 5, 2007

(54) USE OF LOW FOAM PERCARBOXYLIC ACID BASED PRODUCTS CONTAINING SURFACTANTS FOR CIP-DISINFECTION

(75) Inventor: Siegfried Bragulla, Monheim (DE)

(73) Assignee: Ecolab Inc., St. Paul, MN (US)

( * ) Notice: Subject to any disclaimer, the term of this patent is extended or adjusted under 35 U.S.C. 154(b) by 329 days.

(21) Appl. No.: 10/451,465

(22) PCT Filed: Dec. 12, 2001

(86) PCT No.: PCT/EP01/14560

§ 371 (c)(1),
(2), (4) Date: Jul. 28, 2003

(87) PCT Pub. No.: WO02/50233

PCT Pub. Date: Jun. 27, 2002

(65) Prior Publication Data

US 2004/0029755 A1 Feb. 12, 2004

(30) Foreign Application Priority Data

Dec. 21, 2000 (DE) ..... 100 64 372

(51) Int. Cl.

| | |
|---|---|
| ***C11D 1/12*** | (2006.01) |
| ***C11D 1/75*** | (2006.01) |
| ***C11D 3/39*** | (2006.01) |
| ***C11D 3/395*** | (2006.01) |
| ***B08B 3/04*** | (2006.01) |

(52) U.S. Cl. ..... 510/234; 510/218; 510/219; 510/372; 510/495; 510/503; 134/34; 134/36; 134/41

(58) Field of Classification Search ..... None
See application file for complete search history.

(56) References Cited

U.S. PATENT DOCUMENTS 5,567,444 A * 10/1996 Hei et al. ..... 424/616
5,861,366 A 1/1999 Ihns et al.
6,436,445 B1 * 8/2002 Hei et al. ..... 424/667
6,627,593 B2 * 9/2003 Hei et al. ..... 510/375
6,679,274 B2 * 1/2004 Gruszczynski et al. .. 134/22.12

FOREIGN PATENT DOCUMENTS

| | | |
|---|---|---|
| WO | WO9702753 | 1/1997 |
| WO | WO0029038 | 5/2000 |

OTHER PUBLICATIONS

Herbert P. Fiedler, Lexikon der Hilfsstoffe fur Pharmazie, Kosmetik und angrenzende Gebiete (1989), 4 pages.

Karl Heinz Wallhäuβer, Praxis der Sterilisation Desinfektion—Konservierung (1995), 8 pages.

* cited by examiner

*Primary Examiner*—Gregory R. Del Cotto
(74) *Attorney, Agent, or Firm*—Andrew D. Sorensen; Anneliese S. Mayer

(57) ABSTRACT

The use of an agent containing surfactant components chosen from sulfonic acids or sulfonates, alkylamine oxides, ethercarboxylic acids, and alkylether sulfates, in total amounts of 0.01 to 1 wt. %, preferably 0.05 to 0.5 wt. %, with respect to the entire agent, and also one or more percarboxylic acids chosen from a) those peracids or salts of peracids with general formula (I) $R^2$—$O_2C$—$(CH_2)_x$—$CO_3H$ in which $R^2$ is hydrogen or an alkyl group with 1 to 4 carbon atoms and x is a number from 1 to 4, and/or b) phthalimido-percarboxylic acids (II), in which the percarboxylic acid segment contains 1 to 18 carbon atoms, and/or c) compounds of the formula (III) $R^1$—$CO^3H$ in which $R^1$ is an is an alkyl or alkenyl group with 1 to 18 carbon atoms, for disinfection purposes in CIP processes.

12 Claims, No Drawings

USE OF LOW FOAM PERCARBOXYLIC ACID BASED PRODUCTS CONTAINING SURFACTANTS FOR CIP-DISINFECTION

The present invention provides the use of low-lather, surfactant-containing percarboxylic acid agents for CIP disinfection.

The use of halogen-releasing substances, halocarboxylic acids such as monobromoacetic acid, oxidative compounds such as chlorine dioxide, peracetic acid, active chlorine and other antimicrobial substances such as isothiazolinones for cleaning and/or disinfecting hard surfaces is known.

Furthermore, many antimicrobial agents such as, inter alia, oxidative agents, organic acids, phenyl compounds or guanidines and many other compounds are mentioned in K. H. Wallhäusser "Praxis der Sterilisation, Desinfektion und Konservierung", 5th ed. (1995) and in H. P. Fiedler "Lexikon der Hilfsstoffe für Pharmazie, Kosmetik und angrenzende Gebiete", 3rd ed. (1989).

Depending on the formulation, for example in combination with foaming surfactants, it may be that these types of active substances promote the production of foam in the cleaning solution, which is undesirable, for example, in some fields of application in the food producing industry and also in the pharmaceutical or cosmetics industry.

In particular in CIP cleaning processes, there is a demand for agents where the foaming characteristics are not a problem during use and with which at the same time particularly good wetting of the surfaces being treated is achieved.

Accordingly, the object of the present invention is to find simple agents which achieve a very good disinfectant result when used for disinfection in CIP processes and at the same time have a positive effect on the wetting properties without having foam characteristics which might cause problems in a CIP process being observed.

Before dealing with how this object is achieved, in the following, an explanation is given of what a CIP process is understood to mean in the context of the present invention. CIP is a familiar abbreviation in the specialist field and means Cleaning in Place.

By CIP, a person skilled in the art understands that hard surfaces of items, containers, tanks such as milk tankers or fermentation tanks in breweries are generally automatically treated with cleaning and/or disinfecting agents stored on site via equipment or devices installed on site on or in the item being cleaned, such as, for example, piping, pumps, nozzles, containers, spray-heads.

Accordingly, CIP cleaning, as understood by a person skilled in the art, is the cleaning and/or disinfection of hard surfaces in a specific process, the CIP process. Due to the turbulent motion of the cleaning and disinfecting solution resulting from pumping, spraying and other processes, agents and solutions which tend to produce foam are completely unsuitable for a CIP process.

For his reason, in practice the use of agents which contain highly foaming surfactants such as sulfonic acids or sulfonates, alkylamine oxides, ethercarboxylic acids, alkylether sulfates, are basically avoided in the context of CIP processes.

On the one hand, in particular in CIP processes, the wetting characteristics of the agent used are of especial importance. Thus, bacterial problems often occur in CIP disinfection processes when, although sufficient active disinfectant is used, this does not reach the surface to be disinfected or does not adhere to this surface for a sufficiently long time, due to low wetting power. This may be due to a variety of factors. On the one hand, it may be that the equipment and devices used for the CIP process are poorly matched to each other or, for other reasons, these do not function as required. Examples are: the spray nozzle is blocked or the spray pressure produced by the pumps is too low or the agent does not reach the surface to be disinfected, as a result of faulty planning, due to the presence of objects which stand in the way of the spray stream and lead to so-called spray shadows.

In this connection, it should be mentioned that these types of problems occur time and time again in practice and that the optimally adjusted CIP unit is actually the exception. There again, due to plant surfaces which consist of different materials such as, stainless steel, copper, brass, polyethylene, polypropylene, polyvinyl chloride, polyacrylate, polycarbonate and also sealing materials such as, for example, EPDM (ethylenediamine), NBR (nitrilobutadiene), silicone, Viton, Teflon, etc., uniform wetting of the whole area of the material surfaces for a sufficiently long time can be achieved only with difficulty.

Further difficulties with regard to wetting are provided in CIP processes by the complexity of the structure of the industrial scale production units used to produce the very wide variety of different foodstuffs in the milk industry, cheese industry, ice-cream industry, drinks industry, meat industry and confectionery industry, which is why structurally restricted areas are present which are difficult to reach with the agent. Complete wetting at the application concentration required, with the maintenance of a minimum contact time, using selected disinfectants, however, is absolutely necessary for reliable destruction of all harmful microorganisms in the previously cleaned plant.

Another disadvantage of commonly used aqueous disinfectant solutions for CIP processes is also, due to the poor wetting characteristics, that they are not able to reach into microscopically small gaps, surfaces, scratches and inaccessible edges and corners of areas of the plant made of stainless steel in order also to completely destroy harmful microorganisms here.

On the other hand, it is known that surface-active surfactants are able to compensate for this disadvantage. However, it is also known that many surfactants, due to their strong wetting effect, exhibit very intense foaming behavior under the conditions of application. Foaming disinfectant solutions cannot be used in the field of CIP plants for disinfecting closed circuits. Intense foam production would impair the technical function of these plants and lead to unwanted operating problems. Therefore, a person skilled in the art does not use surfactant components in CIP processes, in particular when using percarboxylic acid-containing agents.

Surfactants which act in a low-lather manner in the CIP field are, for example, substances such as fatty alcohol ethoxylates and propoxylates. These classes of substances are forbidden for use because, via the mechanism of the turbidity point, they are low-lather only at elevated temperatures (>30° C.). Since the percarboxylic acids being considered in accordance with the present invention are preferably used cold (5° C. to 30° C.), the mechanism of these surfactants cannot be used. Other surfactants tested, which are still low-lather even in the cold, have the disadvantage that they are destroyed by the strong oxidizing power of the disinfectant (percarboxylic acid) or else they themselves destroy the disinfectant. Contrary to the prejudices of the specialist world, however, trials on CIP disinfection using oxidation-stable foaming surfactants were performed in the context of the present invention. This showed that these, when present in an extremely low concentration range, are able to reduce the surface tension of the application solution of the disinfectant used in such a way that complete wetting of difficult-to-wet polymer materials and rubber seals and also scratches and gaps in metal surfaces is ensured.

Thus, the present invention provides the use of an agent which contains surfactant components selected from sulfonic acids or sulfonates, alkylamine oxides, ethercarboxylic acids and alkylether sulfates in a total amount of 0.01 to 1 wt. %, preferably 0.05 to 0.5 wt. %, with respect to the total agent, and also one or more percarboxylic acids chosen from a) those peracids or salts of peracids with the general formula I $$R^2—O_2C—(CH_2)_x—CO_3H \quad (I)$$

in which $R^2$ is hydrogen or an alkyl group with 1 to 4 carbon atoms and x is a number from 1 to 4, and/or b) phthalimido-percarboxylic acids (II), in which the percarboxylic acid segment contains 1 to 18 carbon atoms, and/or c) compounds of the formula III $$R^1—CO_3H \quad (III)$$

in which $R^1$ is an alkyl or alkenyl group with 1 to 18 carbon atoms, for disinfection purposes in CIP processes.

An agent to be used according to the invention preferably contains sulfonic acids or sulfonates which are selected from xylene, octyl, naphthyl and alkylbenzene sulfonic acids or sulfonates, wherein in the last case, the alkyl group contains between 6 and 16 carbon atoms.

An agent to be used according to the invention very particularly preferably contains alkylbenzene sulfonic acids or sulfonates and/or ethercarboxylic acids as surfactants.

If alkylamine oxides are present as preferred components in the agent to be used according to the invention, these are preferably chosen from trialkylamine oxides with one alkyl group containing 8 to 20 carbon atoms and two alkyl groups with a smaller number of carbon atoms in the alkyl chains, wherein the two shorter alkyl groups may be identical or different, wherein it is very particularly preferred that the amine oxide(s) chosen are tallow oil-(2-hydroxyethyl)-amine oxide, oleyl-bis-(2-hydroxyethyl)-amine oxide, coconut oil-bis-(2-hydroxyethyl)-amine oxide, tetradecyldimethyl-amine oxide and/or an alkyldimethyl-amine oxide which contains 12 to 18 carbon atoms in the alkyl chain.

The one or more percarboxylic acids mentioned preferably constitute, in the agent to be used according to the invention, a total of 1 to 40 wt. %, particularly preferably 2.5 to 15 wt. %, with respect to the entire agent.

It is also preferred that a) as peracids in accordance with the general formula I, peracids are present in which $R^2$ is hydrogen or a methyl group, and/or b) as peracids, phthalimido-peracids are present in which the percarboxylic acid segment contains 1 to 8 carbon atoms, and/or c) as peracids in accordance with the general formula III, peracids with an alkyl or alkenyl group with 1 to 12 carbon atoms are present.

It is then particularly preferred that one or more compounds chosen from peracetic acid, perpropionic acid, peroctanoic acid, phthalimidoperhexanoic acid, phthalimidoperoctanoic acid, petsuccinic acid, monomethylpersuccinate, perglutaric acid, monomethyl perglutarate, peradipic acid, monomethyl peradipate, persuccinic acid, monomethyl persuccinate, are present as peracids in the agent to be used according to the invention.

In another preferred embodiment, the agent to be used according to the invention, prior to use in CIP processes, is diluted to give a disinfectant solution which contains, with respect to the entire disinfectant solution, 0.05 ppm to 100 ppm, particularly preferably 0.5 ppm to 50 ppm of the surfactants mentioned.

It is also preferred that the agent to be used according to the invention is diluted, prior to use in CIP processes, to give a disinfectant solution which contains 10 ppm to 2000 ppm, preferably 50 ppm to 1000 ppm, with respect to the disinfectant solution, of the percarboxylic acids mentioned.

Agents to be used according to the invention or their diluted solutions are preferably used for CIP disinfection in the foodstuffs, pharmaceuticals or cosmetics industries.

The invention also provides a process for cleaning and/or disinfecting plants in which a) the plant is cleaned with alkaline and/or acid agents, if required, in an earlier step, then b) optionally, the surfaces of the plant are washed with water and then c) an agent to be used according to the invention or a solution thereof diluted with water obtainable according to the invention is pumped and/or sprayed into the plant manually or using an automatic system, wherein the temperature of application is between 0 and 50° C., preferably between 0 and 30° C., and the pumping or spraying times are between 1 and 120 minutes, preferably between 5 and 60 minutes and the plant is rinsed with water of drinking water quality, if so desired, after completion of the treatment.

The agents to be used according to the invention preferably contain additional components with complex-forming properties.

1-hydroxyethane-1,1-diphosphonic acid, diethylenetriamine pentamethylenephosphonic acid or ethylenediamine tetramethylenephosphonic acid and the alkali metal salts of each of these are suitable, for example, as phosphonic acids.

Preferred forms of application of agents to be used according to the invention are aqueous solutions, gels, emulsions or pastes.

EXAMPLES

In a first series of trials, the antimicrobial effect of surfactant-containing and corresponding surfactant-free peracetic acid disinfectant solutions were tested on *Saccharomyces cerivisiae* var. Diastaticus.

To prepare the peracetic acid disinfectant solutions, agents C1 and E1 were adjusted with water to a concentration of 0.5 wt. % and 1 wt. % respectively, with respect to the entire solution.

The comparison agent C1 mentioned and agent E1 to be used according to the invention are given in table 1. It should be noted that E1 and C1 were prepared in such away that in both cases about 4.5 wt. % of peracetic acid, with respect to the entire agent, was present in the agent to be used.

TABLE 1

| Agents for microbiological testing (composition in wt. %) | | |
|---|---|---|
| Raw material | E1 | C1 |
| Acetic acid | 20 | 20 |
| Hydrogen peroxide | 28 | 28 |
| Hydroxyethanediphosphonic acid | 0.6 | 0.6 |
| Sulfuric acid | 1 | 1 |
| Ethercarboxylic acid - surfactant | 0.35 | 0 |
| Alkylbenzenesulfonic acid (C10–C13) | 0.4 | 0 |
| Remainder to make up to 100 wt. %: water | | |

The results in the quantitative suspension test are given in table 2.

TABLE 2

| Results for fungicidal activity at 20° C. after different exposure times using data on the reduction factors (RF) | | | |
|---|---|---|---|
| | Conc. | *Saccharomyces cerevisiae* DSM 70847 (K5034). Inoculum 6.47 × $10^7$ per ml | |
| Agent | (wt. %) | RF (1 minute) | RF (5 minutes) |
| E1 | 0.5 | 2.12 | >3.52 |
| | 1 | >3.74 | >3.52 |
| C1 | 0.5 | 1.4 | >3.52 |
| | 1 | 2.09 | >3.52 |

It can be seen from the results in the table that the surfactant-containing 1% peracetic acid disinfectant solution E1 achieved the full effect substantially more rapidly, that is within 1 minute, while the surfactant-free 1% peracetic acid disinfectant solution achieved a reduction factor of only 2.09 after 1 minute.

Accordingly, very small amounts of surfactant are required in order to achieve a substantial improvement in the antimicrobial activity.

In a second series of trials, the foaming behavior of peracetic acid disinfectant solutions containing 0.5 wt. % and 1.0 wt. % of E1 and C1 were tested in the standard foam test.

A method for determining the foaming behavior of cleaning and disinfecting agents in the CIP circuit was chosen. In this method, a foam is produced by a pumping procedure and the foam is measured.

When performing this procedure, several points have to be thought about and prepared for in detail:

1. Apparatus
   Cylindrical vessel with a constant temperature jacket, linked to a thermostat
   measurement scale (0 cm to 30 cm)
   rotary pump
   thermostat (−10° C. to 110° C.)

2. Reagents
   test solution
   test stain (10 wt. % malt extract beer wort)
   distilled water (0 degrees German hardness (0° dH))

3. Method/Working Procedure 3.1 Testing a Pure Application Solution 2000 g of 0.5 wt. % and 1 wt. % respectively peracetic acid disinfectant solutions were prepared from E1 and C1. The foam test apparatus is rinsed with 500 ml of the particular solution (circulates for 5 minutes). Then the apparatus is filled to a depth of 2.5 cm (measurement scale) with the solution and taken to a test temperature of 5° C.

Then the solution is pumped round the circuit at a flowrate of 115 l/h. The foam being produced in this process is read off on the measurement scale after 10 minutes (height of foam in cm).

After switching off the pump, the rate of breakdown of the foam is determined from the height of foam after 1, 3 and 5 minutes.

3.2 Testing the Solution with Stains Present

Add to 500 ml of solution: 100 ml of test stain

Test as described under 3.1

Add a further 100 ml of test stain after the test.

Repeat the test described in 3.1.

The results with the peracetic acid disinfectant solutions of E1 and C1 tested containing 0.5 wt. % and 1.0 wt. % respectively are given in table 3.

TABLE 3

| Height of foam in cm in the standard foam test at 5° C. without and with the addition of a test stain | | | | |
|---|---|---|---|---|
| | Conc. | Height of foam for different amounts of test stain (T1) | | |
| Agent | (wt. %) | 0 ml T1 | 100 ml T1 | 200 ml T1 |
| E1 | 0.5 | 0 | 1 | 5 |
| | 1 | 0 | 2 | 8 |
| C1 | 0.5 | 0 | 1 | 3 |
| | 1 | 0 | 1 | 5 |

It can be seen from the results in the table that the CIP process is not impaired by the unwanted presence of foam when restricting the surfactant to the amounts mentioned in E1.

In another series of trials, the wetting characteristics of peracetic acid disinfectant solutions containing 0.1 wt. %, 0.5 wt. % and 1.0 wt. % of E1 and C1 were tested.

For this, the appropriately diluted solutions of E1 and C1 respectively were placed in 250 ml glass beakers.

Then, previously degreased stainless steel sheeting was immersed in these solutions. In the next step, the sheeting was removed from the solutions with tongs. The residual solution was allowed to run off for 10 seconds. Then the extent of surface wetting was estimated visually.

It was demonstrated that with all three concentrations of E1, about 95% of the degreased stainless steel sheeting was wetted.

In contrast, it was shown that in the case of stainless steel treated with different concentrations of C1, in all cases only about 10% was wetted.

It is deduced from this that, even with the very low concentrations of surfactant in E1, there are considerable advantages with respect to wetting as compared with surfactant-free agents.

The invention claimed is:

1. A method of disinfecting a hard surface in a CIP cleaning process comprising:

a. washing the surface with an alkaline or acid agent;

b. rinsing the surface with water;

c. applying a composition to the surface for 1 to 120 minutes, wherein the composition consists of:

i. from about 0.05 ppm to about 0.5 ppm of a surfactant, wherein the surfactant is selected from the group consisting of sulfonic acids, sulfonates, alkylamine oxides, ethercarboxylic acids, alkylether sulfates, and mixtures thereof; and ii. a percarboxylic acid, wherein the percarboxylic acid is selected from the group consisting of peracids having the general formula $R^2$—$O_2C$—$(CH_2)_x$—$CO_3H$, where $R^2$ is hydrogen or a $C_1$-$C_4$ alkyl group and x is a number from 1 to 4;

phthalimido-percarboxylic acids, where the percarboxylic acid segment has from 1 to 18 carbon atoms;

peracids having the general formula $R^1$—$CO_3H$, where $R^1$ is an alkyl or alkenyl group having 1 to 18 carbon atoms;

salts thereof; and mixtures thereof; and iii. water, and iv. optionally a complexing agent; and d. rinsing the surface with water.

2. The method of claim 1, wherein the composition is pumped onto the surface.

3. The method of claim 1, wherein the composition is sprayed onto the surface.

4. The method of claim 1, wherein the temperature of the composition is from 0 to 50° C.

5. The method of claim 1, wherein the temperature of the composition is from 0 to 30° C.

6. The method of claim 1, wherein the applying a composition to a surface occurs from 5 to 60 minutes.

7. A method of disinfecting a hard surface in a CIP cleaning process comprising:

a. providing a composition consisting of:

i. from about 0.01 to about 1 wt. % of a surfactant, wherein the surfactant is selected from the group consisting of sulfonic acids, sulfonates, alkylamine oxides, ethercarboxylic acids, alkylether sulfates, and mixtures thereof; and ii. a percarboxylic acid, wherein the percarboxylic acid is selected from the group consisting of peracids having the general formula $R^2$—$O_2C$—$(CH_2)_x$—$CO_3H$, where $R^2$ is hydrogen or a $C_1$-$C_4$ alkyl group and x is a number from 1 to 4;

phthalimido-percarboxylic acids, where the percarboxylic acid segment has from 1 to 18 carbon atoms;

peracids having the general formula $R^1$—$CO_3H$, where $R^1$ is an alkyl or alkenyl group having 1 to 18 carbon atoms;

salts thereof; and mixtures thereof; and iii. optionally a complexing agent; and b. diluting the composition with water to form a dilute solution having from 0.05 ppm to 0.5 ppm surfactant;

c. washing the surface with an alkaline or acid agent;

d. rinsing the surface with water;

e. applying the dilute solution to the surface for 1 to 120 minutes; and f. rinsing the surface with water.

8. The method of claim 7, wherein the dilute solution is pumped onto the surface.

9. The method of claim 7, wherein the dilute solution is sprayed onto the surface.

10. The method of claim 7, wherein the temperature of the dilute solution is from 0 to 50° C.

11. The method of claim 7, wherein the temperature of the dilute solution is from 0 to 30° C.

12. The method of claim 7, wherein the applying the dilute solution to a surface occurs from 5 to 60 minutes.

* * * * *